US006003168A

United States Patent [19]

Steadman

[11] Patent Number: 6,003,168

[45] **Date of Patent: *Dec. 21, 1999**

[54] PERSON MOVEMENT APPARATUS

[76] Inventor: William David Steadman, 111-4800 SE., Federal Hwy., Stuart, Fla. 34997

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,841

[22] PCT Filed: Oct. 5, 1995

[86] PCT No.: PCT/GB95/02359

§ 371 Date: Apr. 2, 1997

§ 102(e) Date: Apr. 2, 1997

[87] PCT Pub. No.: WO96/10982

PCT Pub. Date: Apr. 18, 1996

[30] Foreign Application Priority Data

Oct. 6, 1994 [GB] United Kingdom ..... 9420207

[51] Int. Cl.[6] ..... A47K 3/02

[52] U.S. Cl. ..... 4/562.1

[58] Field of Search ..... 4/560.1–563.1

[56] References Cited

U.S. PATENT DOCUMENTS

| | | | |
|---|---|---|---|
| 2,045,110 | 6/1936 | Spiess . | |
| 2,664,142 | 12/1953 | Scheuerman . | |
| 2,697,475 | 12/1954 | Dueth . | |
| 3,254,615 | 6/1966 | Gay . | |
| 3,381,317 | 5/1968 | Daniels et al. | 4/563.1 |
| 3,918,108 | 11/1975 | Feyerherm | 4/563.1 |
| 5,129,112 | 7/1992 | Schaffer | 4/562.1 X |
| 5,287,568 | 2/1994 | Mohrmann . | |
| 5,365,618 | 11/1994 | Gilbert | 4/563.1 |
| 5,465,437 | 11/1995 | Herman | 4/560.1 X |

*Primary Examiner*—Charles E. Phillips
*Attorney, Agent, or Firm*—Watts, Hoffmann, Fisher & Heinke, Co., L.P.A.

[57] ABSTRACT

Apparatus 10 for moving a person into and out of a bath 12. The apparatus comprising a seat 48 mounted by pivotal linkages 38 and 62. The seat 48 can be raised using a ram 56. The linkages 38,62 are arranged such that when the seat 48 is raised beyond a particular height the seat 48 tilts rearwardly whereby to raise the legs of a person on the seat 48 to permit same to be pivotted over the side of a bath without the requirement of lifting the seat 48 far above the bath.

17 Claims, 10 Drawing Sheets

10
12
14
16
18
20
28
34
36
38
40
42
46
48
50
52
58
60
62
70
72

PERSON MOVEMENT APPARATUS

This invention concerns person movement apparatus, and particularly but not exclusively apparatus for moving a person into and out of a conventional bath.

A number of prior arrangements have been provided for moving a person, and particularly a disabled or elderly person into and out of a bath. Some of these arrangements have required particularly adapted baths. Others are permanently mountable on the floor so as to take up a considerable amount of space and only be usable with a specific bath. Such arrangements are only usually practical in a nursing home, hospital or other institution. Others require a person to be lifted high into the air to be able to be swung over a bath, which can be dangerous and also frightening for a user of the apparatus.

According to the present invention there is provided person movement apparatus, the apparatus comprising seating means; means for moving the said seating means in a generally vertical direction to permit said means to be locatable at: an appropriate height adjacent to a bath for a person to sit on, an appropriate height in the bath for the person to wash, and also a height to enable movement of said seating means above a side of the bath; means for tilting the seating means rearwardly whereby to raise the legs of a person on the seating means to enable the person to be moved over the side of the bath without moving the seating means unduly high; and means permitting the seating means to be moved from a first position adjacent the bath to a second position over the bath.

The seating means is preferably pivotally movable between said first and second positions.

The apparatus may comprise a frame upon which the seating means is pivotally mounted. The seating means is preferably mounted on the frame towards the side thereof from which a person enters the bath.

The frame is preferably locatable on a bath, desirably to rest on one end thereof and also to extend part-way along the sides thereof. The frame preferably has a generally U-shaped configuration. Means are preferably provided to prevent the frame lifting relative to the bath. The frame is preferably adjustable so as to be usable with different size baths.

The apparatus is preferably arranged such that the seating means automatically tilts rearwardly when raised above a predetermined height, and returns to its original alignment when lowered back to said predetermined height.

The apparatus preferably comprises lower and upper pivotal linkages connecting with the seating means, with the means for moving said means in a generally vertical direction being engageable with the upper linkage, and abutment means engageable with the lower linkage when the seating means reaches said predetermined height to cause the tilting of the seating means.

The vertical moving means preferably comprises a hydraulic ram. A pump is preferably provided for the ram which may be either electrically or manually operable.

Means may be provided to permit the pump to be operated by a person on the seating means, and with the manual pump a pivoted bar may be provided with one end thereof locatable adjacent the seating means. A release valve may be provided for the ram. Means are preferably also provided to prevent the seating means from dropping quickly, and said means may comprise a shock absorber.

Alternatively, the vertical moving means may comprise a gear drive which may include a belt engageable with the seating means. The upper linkage may be guided by one or more track means.

An electric drive may be provided for the gear drive.

Alternatively manually operable winding means may be provided for the gear drive, and the winding means may be arranged to be operable by a person on the seating means.

Embodiments of the present invention will now be described by way of example only with reference to the accompanying drawings, in which.

Figure 1:
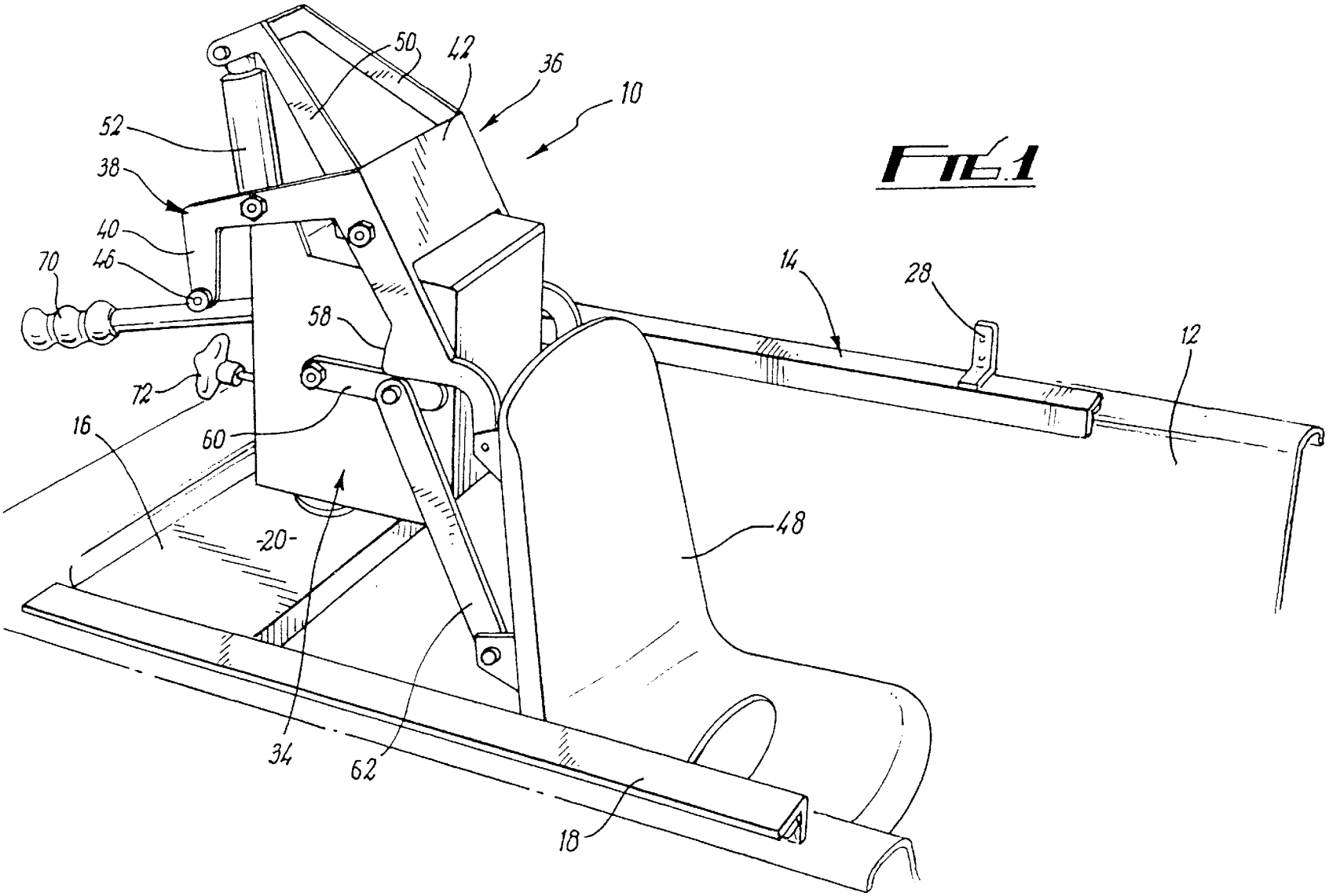
FIG. 1 is a perspective view of a first apparatus according to the invention.

FIGS. 1–5 show person movement apparatus 10 usable to lift a person into and out of a bath 12. The apparatus is usable by a carer, nurse, relative or the like to safely lift the person into the bath 12.

The apparatus 10 comprises a generally U-shape frame 14 which is mountable on the bath 12 such that the base 16 of the U rests on the end of the bath 12 away from the taps, with the side limbs 18 of the U resting on respective sides of the bath 12. The length of the base 16 is adjustable to allow use of the apparatus 10 on different size baths. The base 16 comprises a panel 20 with a generally downward facing channel configuration extending from one limb 18, and a pair of spaced bars 22 extending from the other limb 18, and engageable in the channel section of the panel 20. A suitable locking arrangement with a wing nut 24 is provided for holding the panel 20 and bars 22 in a required relative position.

The limbs 18 are of L-shape section with padding strips 26 on the inside of either limb for secure engagement on the sides of the bath 12 but without damage thereto. Brackets 28 are provided on the wall 30 a short distance above the limb 18 to prevent lifting thereof during use of the apparatus 10. The brackets 28 are arranged to be removable such that they can be fitted on the appropriate one of the limbs 18 for a particular situation. An upstanding cylindrical projection 32 with a collar 33 is provided on the panel 20 so as to be located towards the side of the bath 12 away from the wall 30.

Rotatably mounted on the projection 32 and resting on the collar 33 is a body 34. An upper frame 36 is pivotally mounted on the body 34 to extend above and on each side thereof. The frame comprises a pair of spaced generally inverted L-shape members 38 which have an inwardly turned portion 40 at the free end of one of the limbs. The members 38 are interconnected in the area of their apices by a plate 42. The members 38 are pivotally mounted to respective upstanding stubs 44 on the body 34, at locations on the members 38 adjacent the apices thereof but towards the portions 40.

Rollers 46 are provided on the free end of each of the portions 40. The free ends of the limbs of the members 38 which do not mount the portions 40 pivotally mount a seat 48 on respective sides thereof towards the top of the back of the seat. A projection 58 is provided on each limb of the member 38 which mounts the seat 48, located generally midway between the mounting of the rod 54 and the seat 48 for a purpose hereinafter to be described. A pair of arms 50 extend from the apices of the members 38 and converge together to provide a mounting for one end of a shock absorber 52. A rod 54 extends between the members 38 beneath the plate 42 and pivotally mounts the upper end of a hydraulic ram in the form of a jack 56.

A first pair of relatively short arms 60 are pivotally mounted about one end thereof on each side of the body 34. Towards the other end of the arm 60 are pivotally mounted a pair of further arms 62. The arms 62 are pivotally mounted about one end thereof to the arms 60, and pivotally mount adjacent the other ends thereof the seat 48 at a location spaced downwardly from the mounting of the members 38 on the seat 48.

Within the body 34 the lower end of the jack 56 is mounted on a plate 64 which is pivotally mounted to the base of the body 34 by a hinge pin 66. A slot 68 is provided in the top of the body 34 for the jack 56 to extend through. An actuator arm 70 for the jack 56 extends through an opening in the body 34 on the opposite side thereof to the seat 48. A release valve actuator 72 for the jack 56 extends beneath the arm 70. A lower pivotal mounting for the shock absorber 52 is also provided within the body 34.

Figure 2:
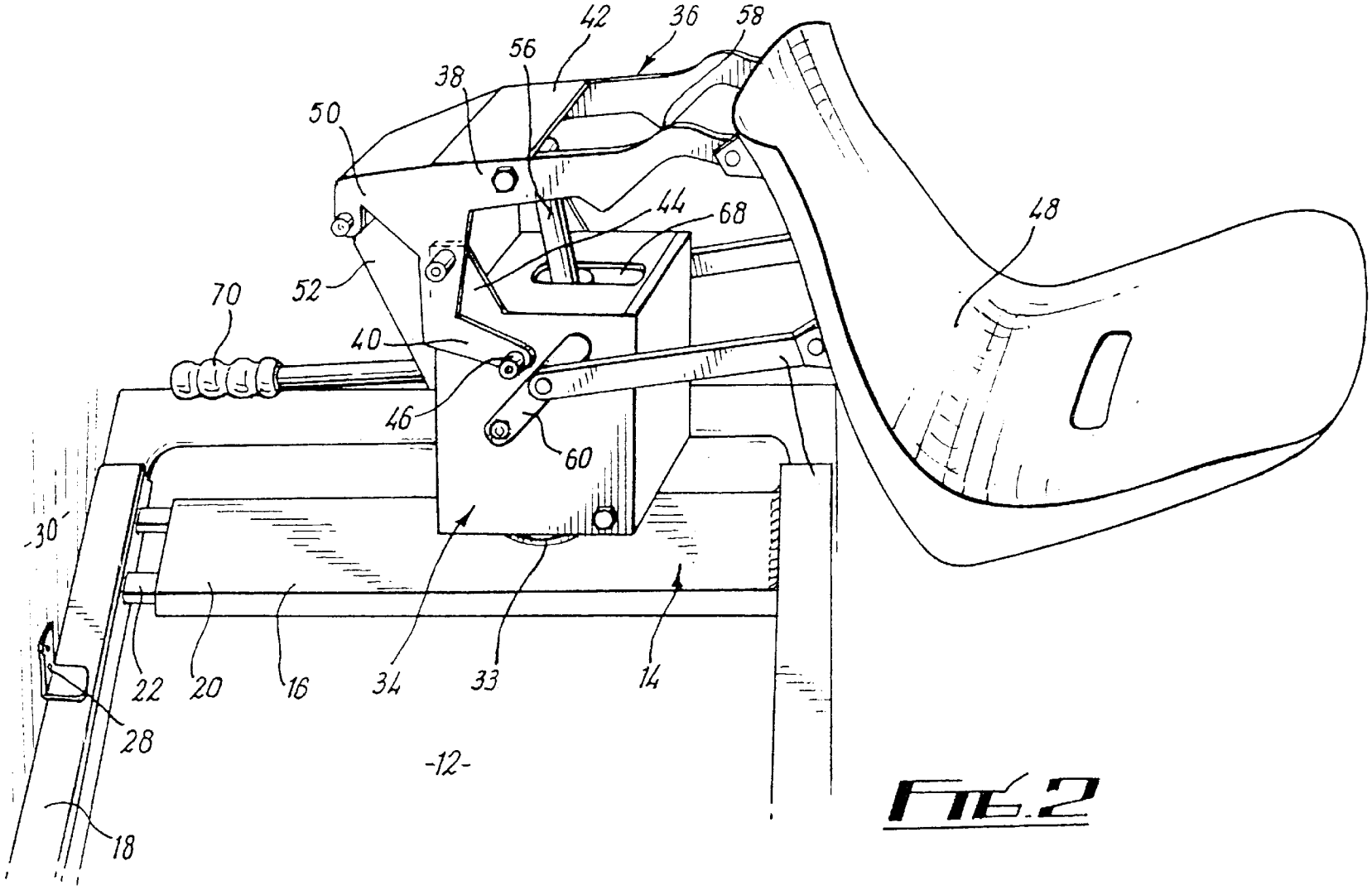
FIG. 2 is a perspective view of the apparatus of FIG. 1 in a different condition.
Figure 3:
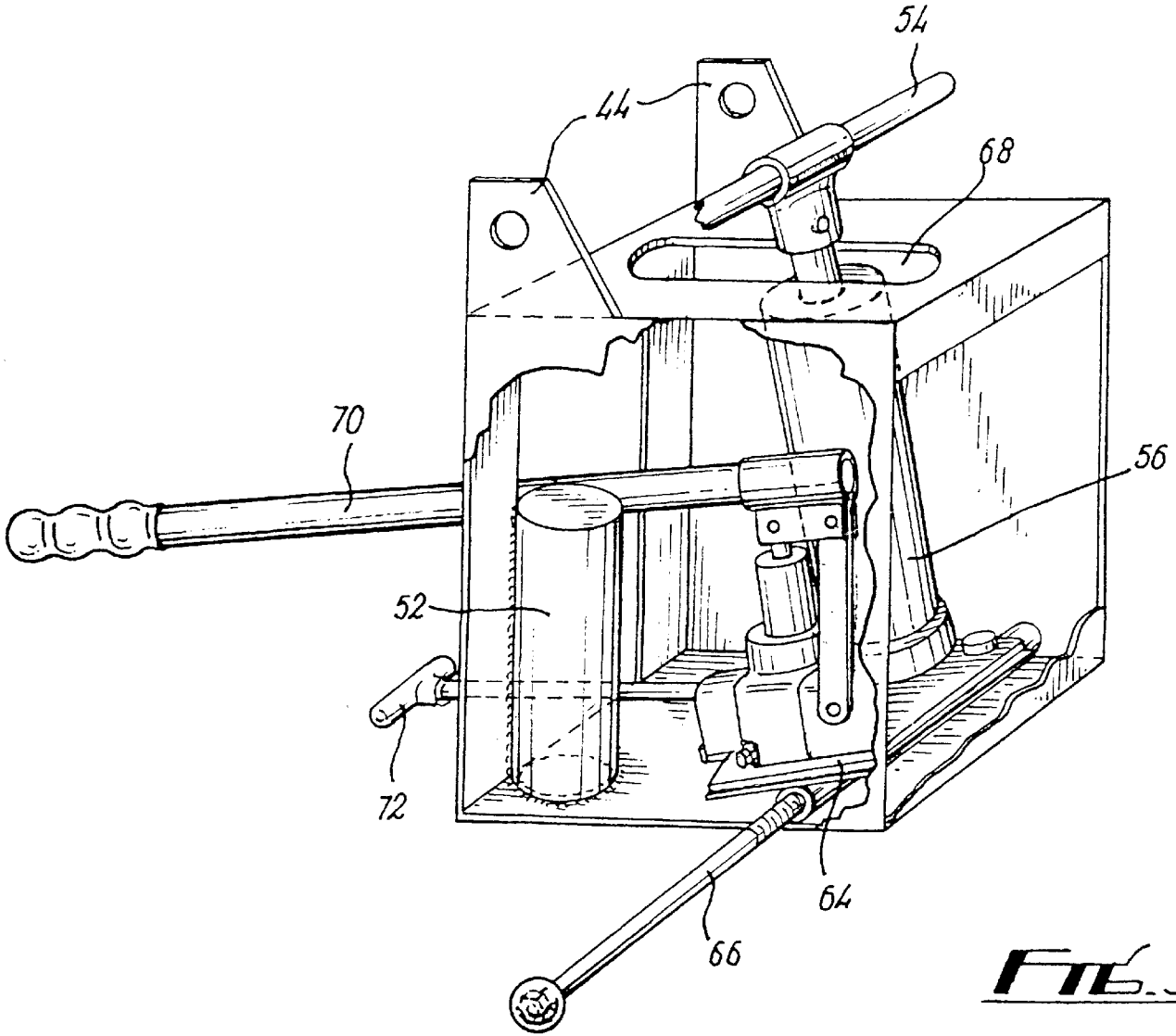
FIG. 3 is a partially cut-away view of part of the apparatus of FIG. 1.
Figure 4:
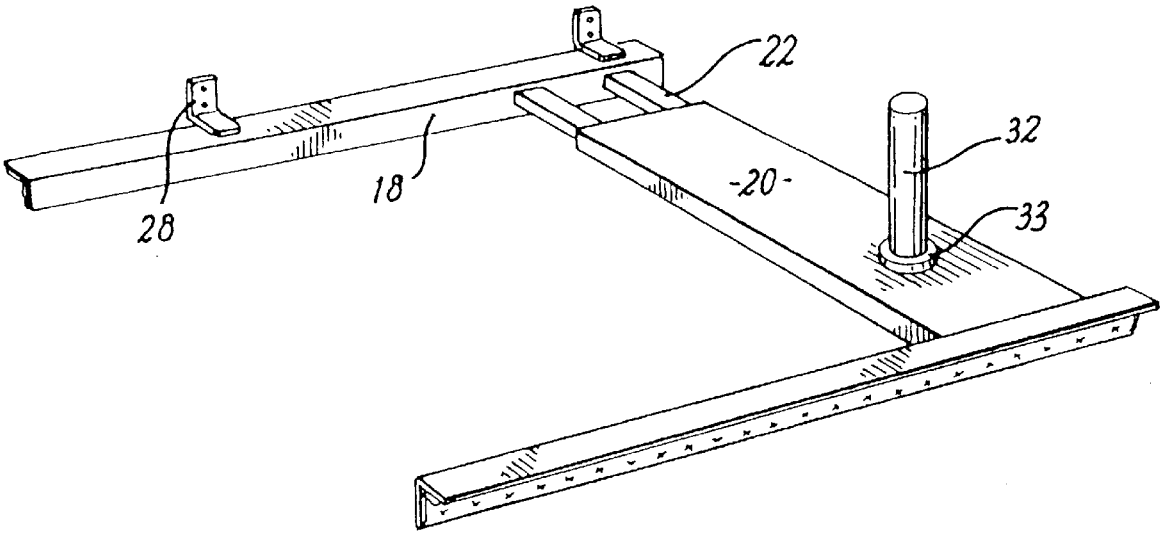
FIG. 4 is a perspective view of part of the apparatus of FIG. 1.
Figure 5:
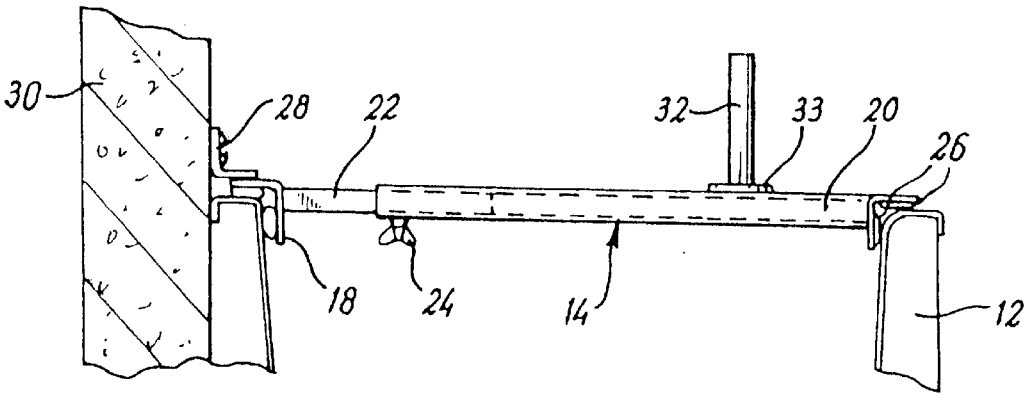
FIG. 5 is a cross-sectional view through the part of the apparatus shown in FIG. 4.

In use, the seat 48 is pivotted about the projection 32 so as to be located to the side of the bath as shown in FIG. 2. With the release valve 70 open the seat 48 will be in its lowest position, as shown in FIG. 1, to enable a person to readily get on to the seat 48. In this lowermost position the arrangement is very stable with the projections 58 resting on the respective arms 60. With the valve 72 closed the jack 56 can be actuated by moving the arm 70 up and down. This causes the seat 48 to lift, initially in a generally vertical direction.

As the seat 48 lifts by virtue of extension of the jack 56, the upper frame 36 and the arms 60 rotate in an anticlockwise direction about the respective pivotal mountings thereof on the body 34. Eventually the free ends of the portions 40, and hence rollers 46, engage with the arms 60. As a result of this engagement further actuation of the jack 56 causes the seat 48 to tilt rearwardly as shown in FIG. 2, thereby raising the legs of a person seated thereon.

Once the seat 48 and hence person sitting thereon has been raised sufficiently, the seat 48 can be pivoted about the projection 32 to be located above the bath 12. As the seat 48 is tilted rearwardly, thereby lifting the legs of a person thereon, the amount of lifting of the seat 48 is considerably reduced as would be required if the seat was purely lifted in a vertical direction. The person located above the bath 12 can now be lowered into the bath 12 using the release valve 72. If this is released quickly the shock absorber 52 will prevent the person falling too quickly. The person can then have a bath in a usual manner and be lifted out of the bath by reversing the above procedure.

There is thus described a person movement apparatus with a number of advantageous features. The combined lifting and rearward tilt arrangement means that the seat does not have to be raised to any great height above the bath, thereby making use of the apparatus a less frightening experience and also removing the need for substantial mounting of the apparatus, usually on the floor, to counter the moments which would be encountered during maximum lift. Also, the rearward tilting of the seat provides for an extra feeling of safety for a user.

The U-shaped frame permits mounting of the apparatus on a bath with just two mounting points on the wall. The mounting brackets can be arranged to permit ready removal of the frame thereby permitting the bath to be readily used in a conventional manner. The frame can be arranged to readily be usable when lifting is required from the other side of a bath. As the rearward tilting occurs automatically during the lifting of the seat, operation of the apparatus is a simple one motion operation. As the frame is adjustable the apparatus is readily usable on a wide range of baths.

Figure 6:
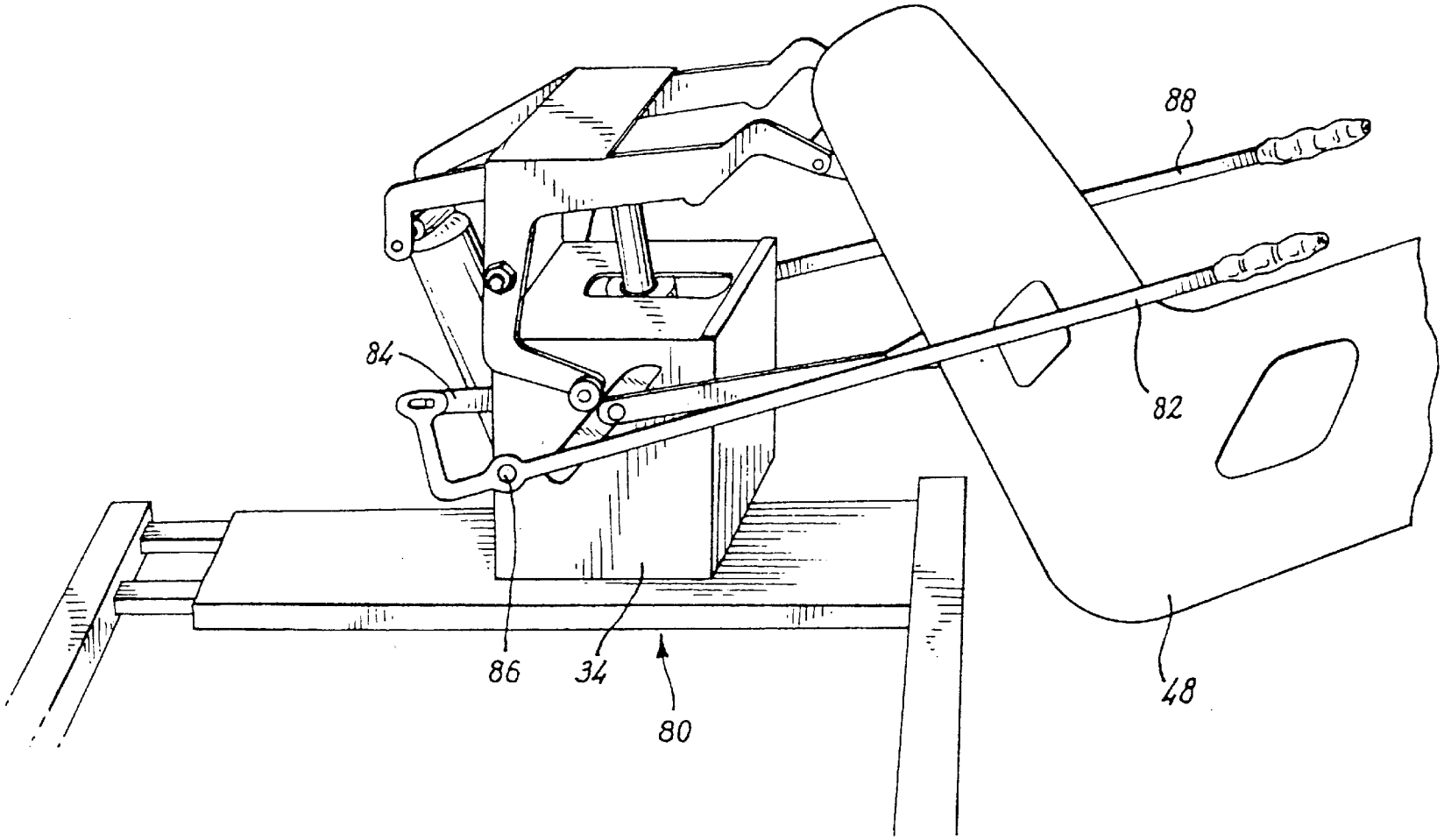
FIG. 6 is a perspective view of a second apparatus according to the invention.
Figure 7:
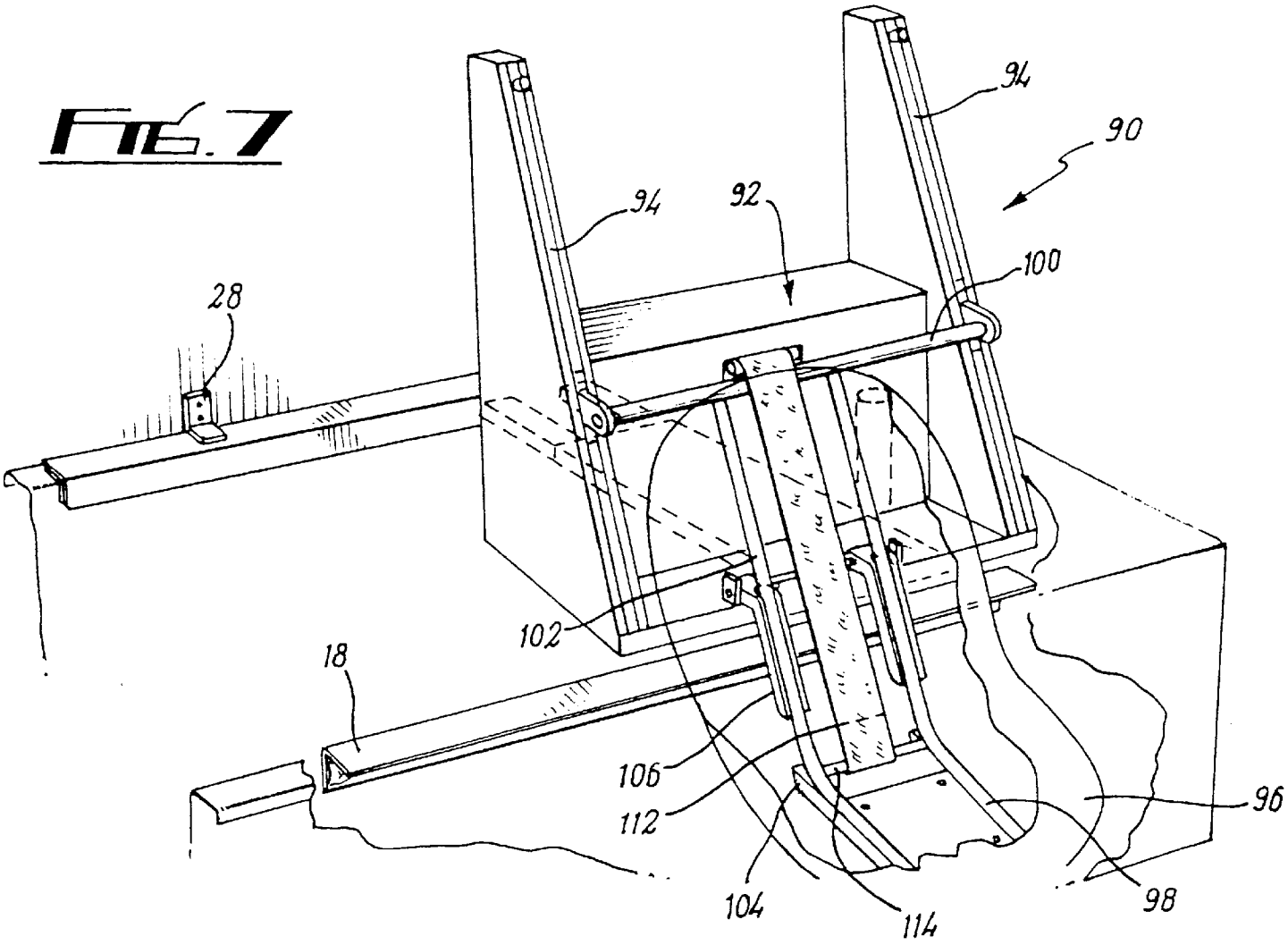
FIG. 7 is a diagrammatic perspective view of a third apparatus according to the invention in a first position.
Figure 8:
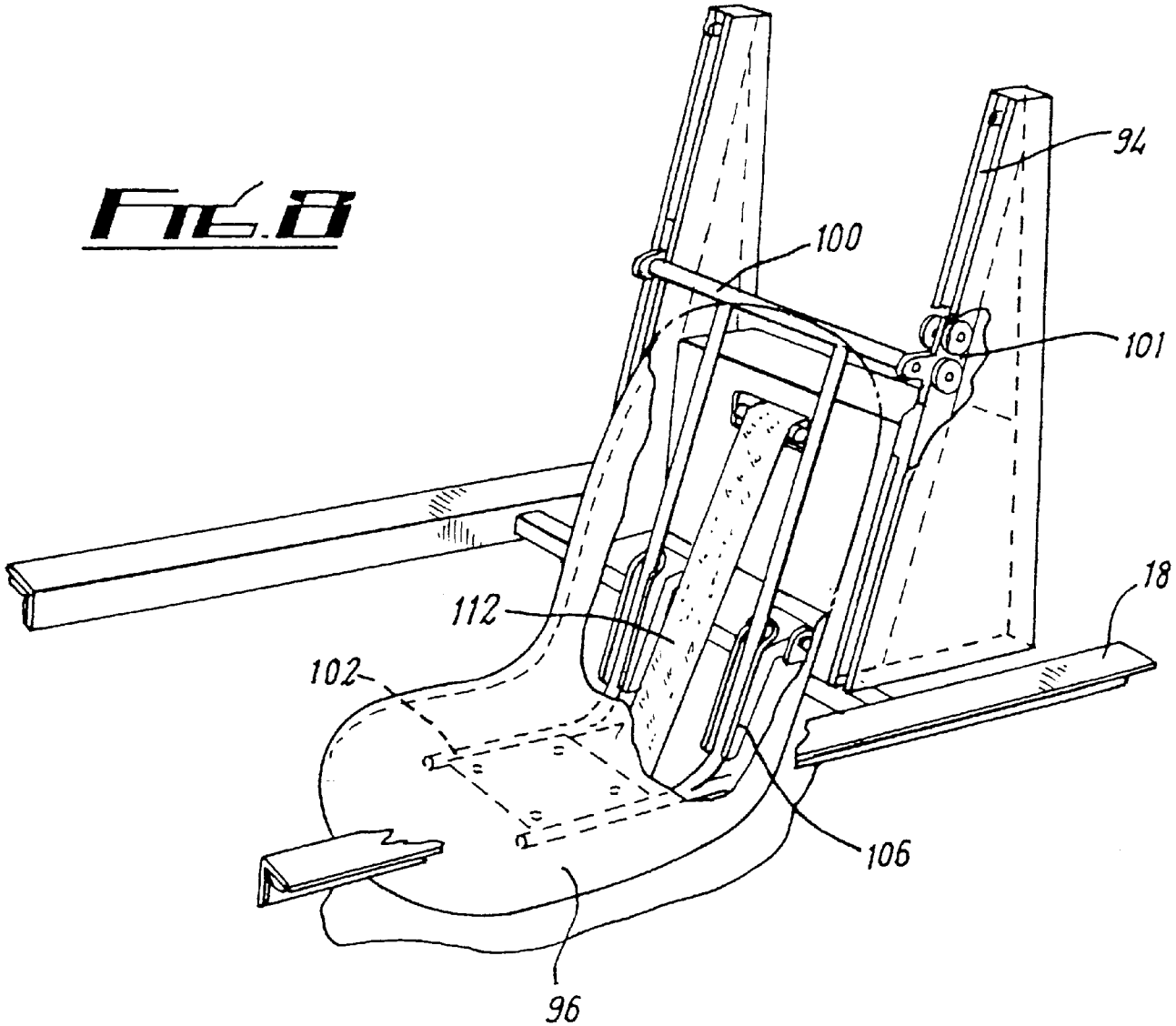
FIG. 8 is a diagrammatic perspective view of the apparatus of FIG. 7 in a second position.

FIG. 6 shows a similar apparatus 80 except that the apparatus 80 is intended to be worked by a person taking a bath. In this instance an arm 82 connected to a shortened actuator arm 84 extends to alongside one side of the seat, and is pivotally mounted to the side of the body 34 at 86. A further arm 88 extends to alongside the other side of the seat 40. The arm 88 is linked to the release valve 72 to permit actuation thereof. The apparatus 80 can be operated in the same way as the apparatus 10 but by a person on the seat 48 making respective up and down movements of the arm 82 and moving the arm 88 as is required.

FIGS. 7–10 show a further person movement apparatus 90 according to the invention. A similar frame 14 is provided which pivotally mounts a body 92. The body 92 comprises a pair of spaced tracks 94 which extend upwardly and slightly rearwardly relative to a seat 96. The seat 96 is mounted on a frame 98 which comprises an upper cross member 100 with ends having formations 101 engageable in the tracks 94. Extending downwardly from the cross member 100 are a pair of spaced elongate members 102 which mount the seat 96 thereon and are profiled to generally follow the contours thereof. Where the members 102 bend beneath the connection of the base and back of the seat 96, a projection 104 extends from each member 102 to point rearwardly.

Figure 10:
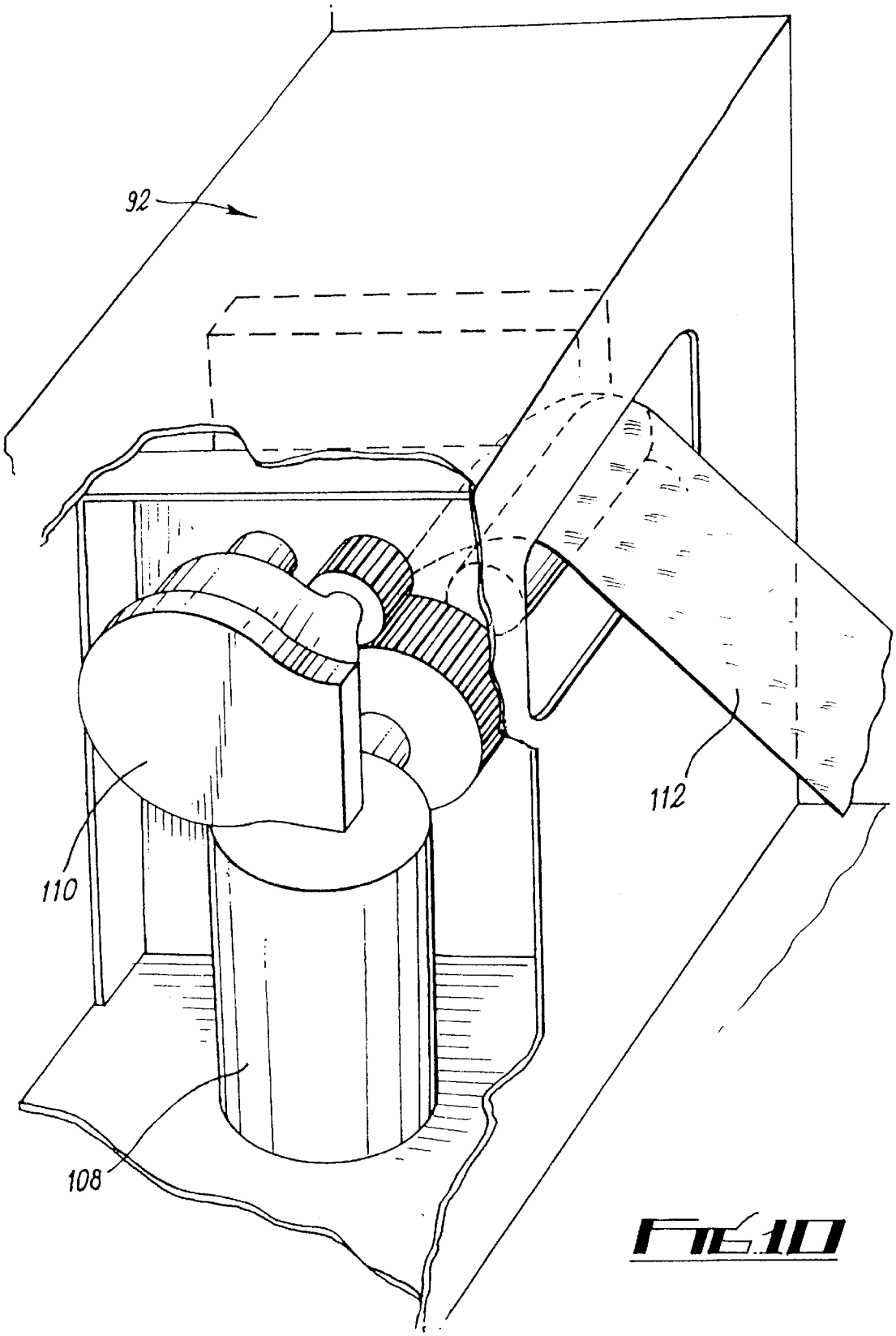
FIG. 10 is a perspective view of part of the apparatus of FIG. 7.

A pair of channel members 106 are pivotally mounted on the frame 14 to extend downwardly therefrom, and such that each member 106 accepts therein one of the members 102. Located between the tracks 94 is an electric worm drive for the apparatus 90. This comprises a motor 108 with a worm drive 110, as shown in FIG. 10. The drive 110 winds a belt 112 inwardly and outwardly from the body 90 as required. The free end of the belt 112 is mounted on a cross piece 114 extending between the members 102 substantially at the junction between the back and base of the seat 96.

Figure 9:
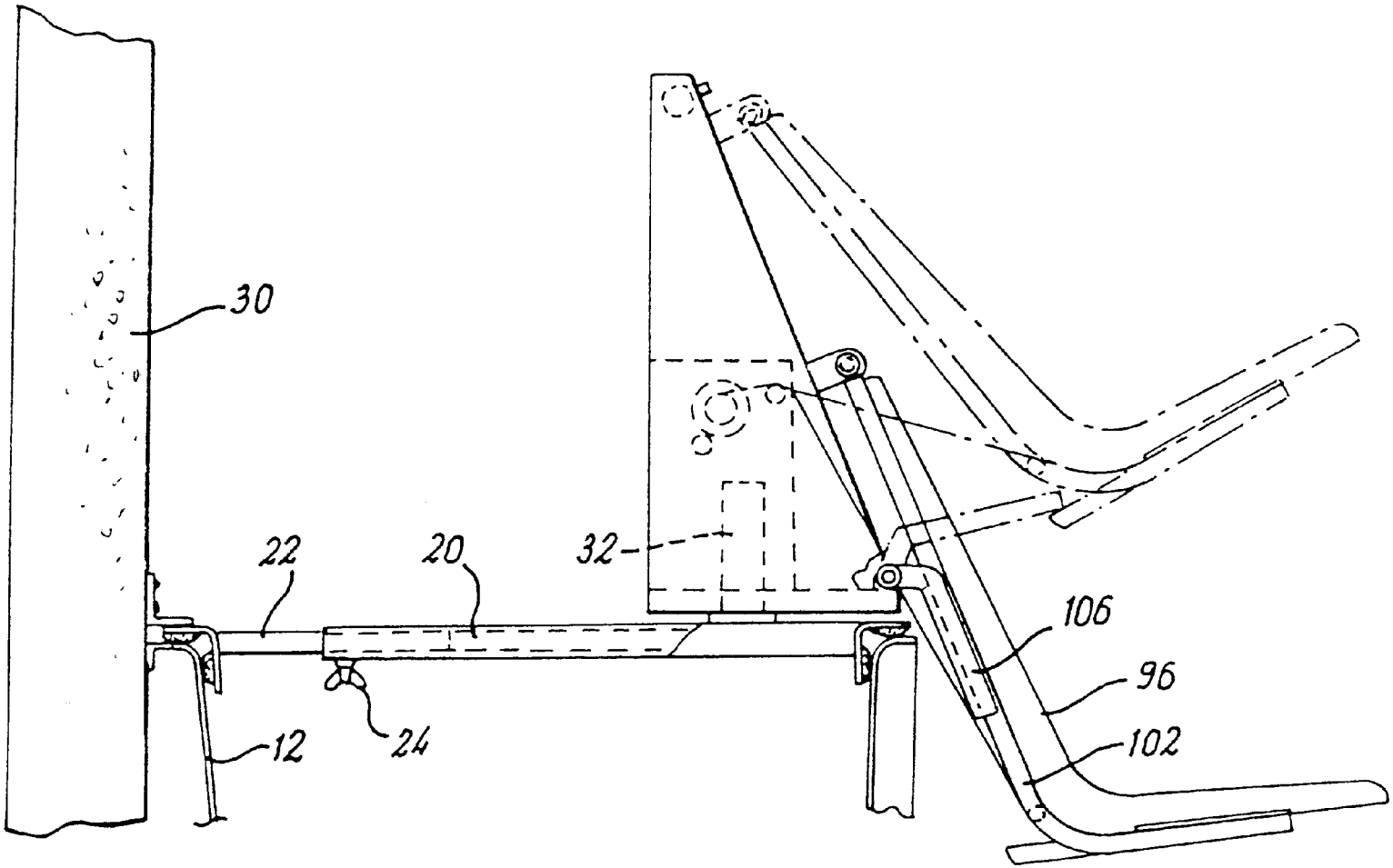
FIG. 9 is a diagrammatic side view of the apparatus of FIG. 7.

In use, the apparatus 90 operates in a generally similar manner to the apparatus 10. Raising of the seat 96 occurs by the belt 112 being wound into the body 92 by the motor 108. When however the projections 104 contact the lower ends of the channel members 106, the projections 104 cannot pass thereup and therefore the members 106 pivot outwardly as shown in FIG. 9 to cause the rearward tilt of the seat 96 at a particular height. The apparatus 90 can be actuated using any suitable controls which could be hand held by a carer etc, or by a person using the bath. The worm drive 110 prevents the seat 96 from falling quickly. There is thus provided an electrically driven version with the advantages of the above described manually operable version.

Figure 11:
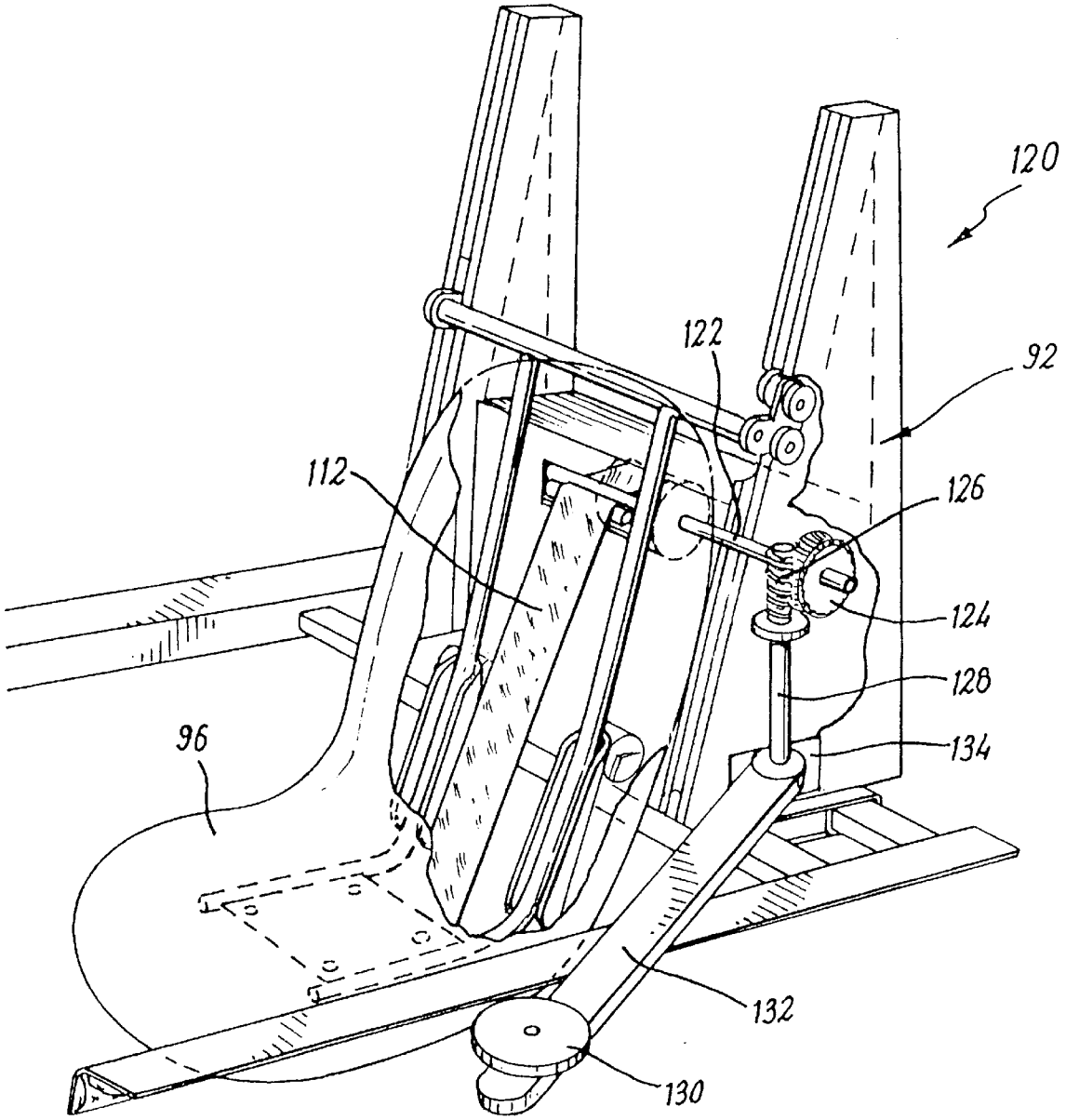
FIG. 11 is a generally similar view to FIG. 8 of a fourth apparatus according to the invention.

FIG. 11 shows a still further person movement apparatus 120 which is similar to the apparatus 90 but is intended to be worked by a person taking a bath. The apparatus 120 is similar to the apparatus 90 except as indicated below. The belt 112 is locatable in the body 92 around a roller mounted on a shaft 122. The shaft 122 extends to the left hand side of the body 92 and mounts a gear 124 towards the end thereof.

The gear 124 is engageable with a vertically orientated worm gear 126 located on the free end of a further shaft 128. The shaft 128 extends from a further gear (not shown) which is connected via a chain drive (also not shown) to a rotatable handle 130. The further gear and chain drive are located in a closed arm 132 which extends from the body 92 through an opening 134 to extend generally alongside the seat 96. The handle 130 is provided extending upwardly from the arm 132 towards the free end thereof.

The apparatus 120 can be operated in a similar manner to the apparatus 90 but by a person winding the handle 130. This could be a person taking a bath or a person located alongside the bath.

Various modifications may be made without departing from this scope of the invention. For example different lifting arrangements could be used, and different control arrangements could be provided for operating these lifting arrangements. A different mounting arrangement could be provided. The first described embodiment or one similar thereto could be provided with an electric pump for actuating the hydraulic cylinder.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A bath lift comprising:

a) a frame for mounting on a side of a bath tub;

b) a seat support relatively moveably mounted on the frame;

c) a seat mounted on the support;

d) a seat movement means operably interposed between and connected to the frame and the seat for moving the seat along a path of travel from a user pickup and discharge position upwardly over such tub side and downwardly into a bathing position and return;

e) the seat movement means including seat tilting means for tilting the seat rearwardly to an inclined position from an upright position as the seat reaches a predetermined height during upward movement as the chair traverses the path whereby to elevate a user's legs relative to such user's torso and thereby reduce the user elevation required to pass over such side of such tub; and, f) the tilting means also being for returning the seat to its upright position when the seat reaches a predetermined position during downward movement of the seat after it has passed over such side of such tub.

2. Apparatus according to claim 1, characterized in that the seat is pivotally movable between said upright and inclined positions.

3. Apparatus according to claim 2, characterised in that means are provided to prevent the seating means from dropping quickly.

4. Apparatus according to claim 3, characterised in that the prevention means comprises a shock absorber.

5. Apparatus according to claim 1, characterized in that the seat is mounted on the frame towards the side thereof from which a person enters such a tub.

6. Apparatus according to claim 1, characterised in that the frame is locatable on such a tub to rest on one end thereof and also to extend part-way along the sides thereof.

7. Apparatus according to claim 6, characterised in that the frame has a generally U-shaped configuration.

8. Apparatus according to claim 1, characterised in that means are provided to prevent the frame lifting relative to such a tub.

9. Apparatus according to claim 1, characterised in that the frame is adjustable so as to be usable with tubs of a range of sizes.

10. Apparatus according to claim 1, further including lower and upper pivotal linkages are operably connected to the seat, with the seat movement means being engageable with the upper linkage, and abutment means engageable with the lower linkage when the seat reaches said predetermined height to cause the tilting of the seat.

11. Apparatus according to claim 10, characterised in that the upper linkage is guided by one or more track means.

12. Apparatus according to claim 1, characterised in that the seat movement means includes a hydraulic ram.

13. Apparatus according to claim 12, characterised in that a pump is provided for the ram and the pump is a selected one of electrically and manually operable.

14. Apparatus according to claim 13, characterised in that a release valve is provided for the ram.

15. The lift of claim 1, wherein the seat movement means is controlled by a selected one of a user and a user assistant.

16. The lift of claim 1, wherein the seat movement includes a prime mover.

17. The lift of claim 16, wherein the prime mover is an hydraulic cylinder.

* * * * *